US010515755B2

(12) United States Patent
Kim et al.

(10) Patent No.: US 10,515,755 B2
(45) Date of Patent: Dec. 24, 2019

(54) COIL ELECTRONIC COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Ki Seok Kim, Suwon-si (KR); Ye Jeong Kim, Suwon-si (KR); Myung Sam Kang, Suwon-si (KR); Kwang Hee Kwon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/507,982

(22) Filed: Jul. 10, 2019

(65) Prior Publication Data

US 2019/0333683 A1 Oct. 31, 2019

Related U.S. Application Data

(63) Continuation of application No. 15/660,640, filed on Jul. 26, 2017, now Pat. No. 10,395,814.

(30) Foreign Application Priority Data

Nov. 3, 2016 (KR) ..... 10-2016-0146030

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 27/29*** | (2006.01) |
| ***H01F 27/32*** | (2006.01) |

(Continued)

(52) U.S. Cl.

CPC ..... *H01F 27/2804* (2013.01); *H01F 17/0013* (2013.01); *H01F 17/0033* (2013.01); *H01F 27/292* (2013.01); *H01F 27/323* (2013.01); *H01F 41/041* (2013.01); *H01F 41/042* (2013.01); *H01F 41/122* (2013.01); *H01F 2017/004* (2013.01); *H01F 2027/2809* (2013.01)

(58) Field of Classification Search

USPC ..... 336/200

See application file for complete search history.

(56) References Cited

U.S. PATENT DOCUMENTS 6,600,404 B1 * 7/2003 Kajino ..... H01F 5/003 257/531
8,451,083 B2 * 5/2013 Okumura ..... H01F 5/003 336/200

(Continued)

FOREIGN PATENT DOCUMENTS

JP 2006-332147 A 12/2006
JP 2011-77157 A 4/2011

(Continued)

*Primary Examiner* — Ronald Hinson
(74) *Attorney, Agent, or Firm* — Morgan, Lewis & Bockius LLP

(57) ABSTRACT

A coil electronic component includes: a plurality of stacked coil layers each including coil patterns including anisotropic plating layers; conductive vias connecting the coil patterns formed on different coil layers to each other; and external electrodes electrically connected to the plurality of coil layers.

12 Claims, 7 Drawing Sheets

(51) Int. Cl.
*H01F 41/12* (2006.01)
*H01F 17/00* (2006.01)

(56) References Cited

U.S. PATENT DOCUMENTS

| | | | | |
|---|---|---|---|---|
| 2011/0074535 | A1 | 3/2011 | Banno | |
| 2011/0291784 | A1* | 12/2011 | Nakatsuji | H01F 17/0013 336/192 |
| 2012/0105188 | A1 | 5/2012 | Lim et al. | |
| 2014/0253277 | A1* | 9/2014 | Takezawa | H01F 27/2804 336/200 |
| 2015/0035639 | A1 | 2/2015 | Nakamura et al. | |
| 2015/0048918 | A1 | 2/2015 | Park et al. | |
| 2016/0343499 | A1* | 11/2016 | Nakamura | H01F 17/0013 |
| 2017/0323726 | A1* | 11/2017 | Sasaki | H01G 4/30 |

FOREIGN PATENT DOCUMENTS

| | | | |
|---|---|---|---|
| JP | 2013-98554 | A | 5/2013 |
| JP | 2013-191863 | A | 9/2013 |
| KR | 10-1210374 | B1 | 12/2012 |
| KR | 10-2015-0015374 | A | 2/2015 |
| KR | 10-2015-0019588 | A | 2/2015 |

* cited by examiner

COIL ELECTRONIC COMPONENT AND METHOD OF MANUFACTURING THE SAME

CROSS-REFERENCE TO RELATED APPLICATION(S)

This application is a Continuation Application of Ser. No. 15/660,640, filed Jul. 26, 2017, which claims the benefit of priority to Korean Patent Application No. 10-2016-0146030, filed on Nov. 3, 2016, the disclosures of which are incorporated herein by reference in their entirety.

BACKGROUND

1. Field

The present disclosure relates to a coil electronic component.

2. Description of Related Art

A coil electronic component, which may be an inductor, a component constituting an electronic circuit, together with a resistor and a capacitor, may be formed by winding coils around a ferrite core or printing the coils on the ferrite core and forming electrodes on both end surfaces of the core, and may be used to remove noise or is used as a component constituting an LC resonant circuit. An inductor may be variously classified as a multilayer inductor, a winding type inductor, a thin film type inductor, or the like, depending on a form of the coil.

In general, an inductor has a form in which coils are embedded in a body formed of an insulating material, and recently, in accordance with demand for miniaturization of elements and diversification of functions, attempts to obtain a high efficiency product having excellent electrical characteristics have been continuously conducted.

SUMMARY

An aspect of the present disclosure may provide a coil electronic component having a reduced thickness which is advantageous in terms of miniaturization and being implemented to have excellent electrical characteristics. Another aspect of the present disclosure may provide a method of effectively manufacturing the coil electronic component having the abovementioned structure.

According to an aspect of the present disclosure, a coil electronic component includes: a plurality of stacked coil layers, the coil layers each including coil patterns including anisotropic plating layers; conductive vias connecting the coil patterns formed on different coil layers to each other; and external electrodes electrically connected to the plurality of coil layers.

The coil patterns may include first layers, and second layers formed on the first layers, the second layers having widths greater than those of the first layers.

The coil electronic component may further include first insulating layers covering the coil patterns.

The coil electronic component may further include second insulating layers covering at least side surfaces of the first insulating layers.

The coil electronic component may further include third insulating layers covering the side surfaces of the first layers.

The third insulating layers may be in contact with the side surfaces of the first layers and lower surfaces of the second layers.

The third insulating layer may be formed of a photosensitive material.

Each of the plurality of coil layers may further include connection patterns disposed outside the coil patterns and externally exposed.

Each of the plurality of coil layers may include a pair of connection patterns.

The coil patterns of an uppermost coil layer and a lowermost coil layer of the plurality of coil layers may be connected to one of the pair of connection patterns.

The external electrodes may include first and second external electrodes of which polarities are different from each other, and a connection pattern of the uppermost coil layer of the plurality of coil layers may be connected to the first external electrode and a connection pattern of the lowermost coil layer of the plurality of coil layers may be connected to the second external electrode.

The coil electronic component may further include conductive vias connecting the connection patterns formed on different levels to each other.

The coil electronic component may further include a core part filling a hole penetrating through the plurality of coil layers and including a magnetic material.

The core part may cover upper and lower portions of the plurality of coil layers.

According to another aspect of the present disclosure, a method of manufacturing a coil electronic component may include: forming a plurality of unit laminates including coil patterns having anisotropic plating layers, insulating layers covering the coil patterns, and conductive vias penetrating through the insulating layers and connected to the coil patterns; stacking the plurality of unit laminates to correspond to one another; and forming external electrodes on external surfaces of a stacking structure of the plurality of unit laminates.

The forming of the plurality of unit laminates may include: forming the coil patterns on a surface of a carrier layer; forming the insulating layers to cover the coil patterns and connection patterns; and forming the conductive vias to penetrate through the insulating layers and connected to the coil patterns.

The forming of the plurality of unit laminates may further include separating the carrier layer from the unit laminate.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
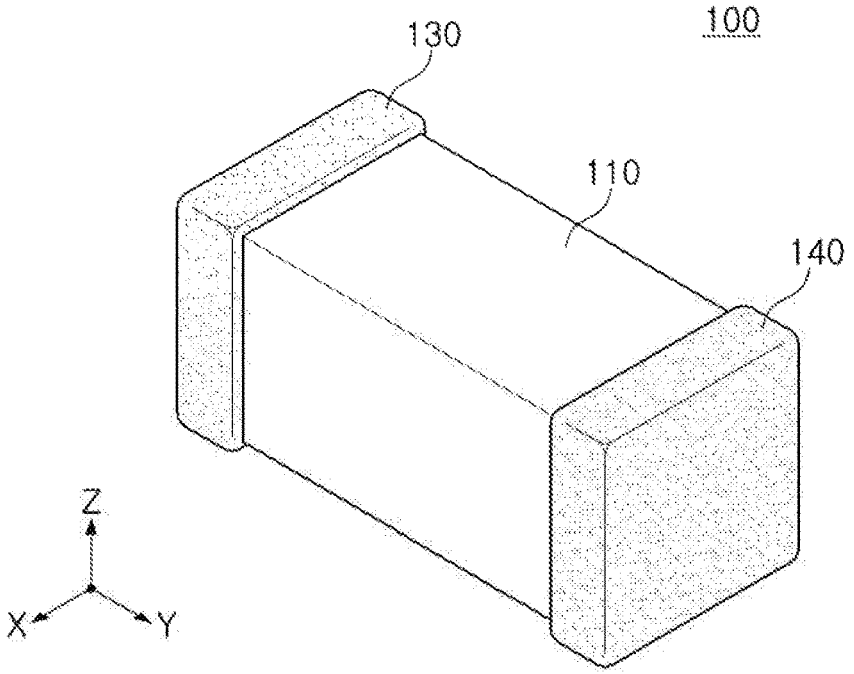
FIG. 1 is a schematic perspective view illustrating a coil electronic component according to an exemplary embodiment in the present disclosure.
Figure 2:
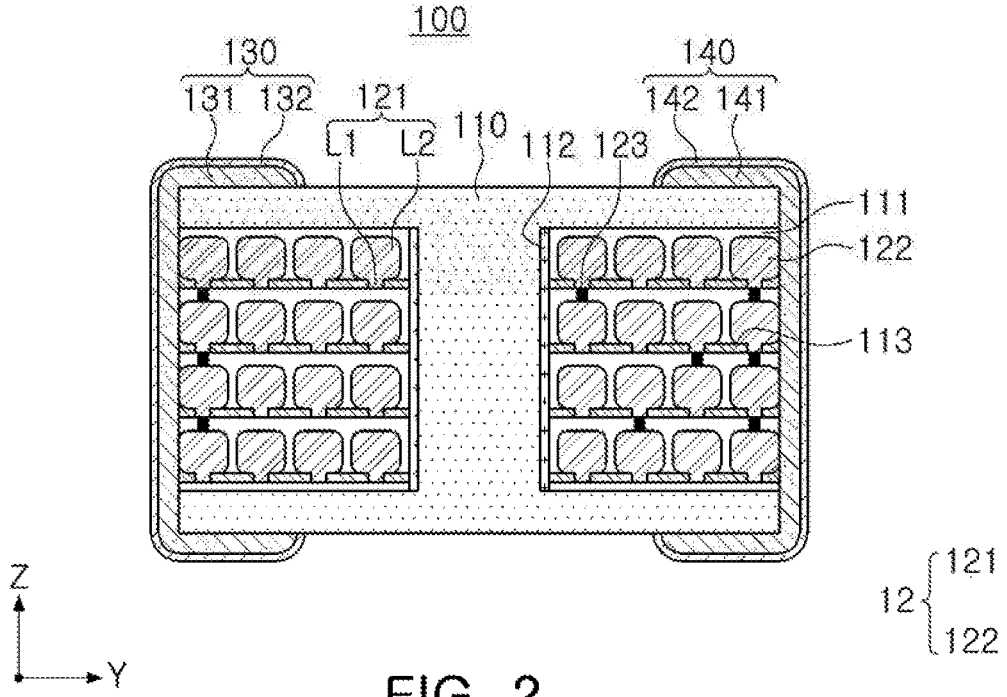
FIG. 2 is a cross-sectional view of the coil electronic component of FIG. 1, depicted so that coil patterns, connection patterns, and conductive vias are visible.
Figure 3:
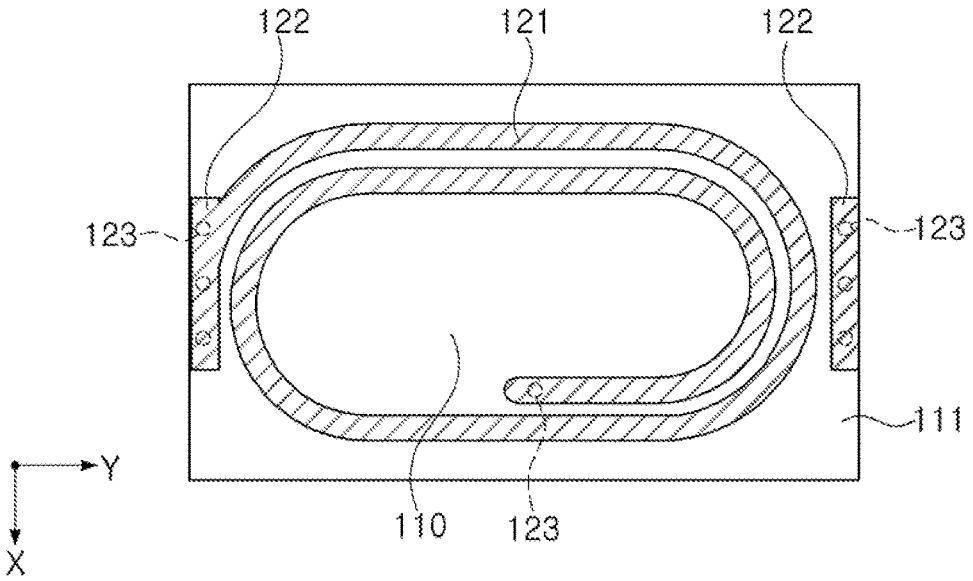
FIGS. 3 and 4 are plan views illustrating coil layers that may be used in the coil electronic component of FIG. 1 in each position.
Figure 4:
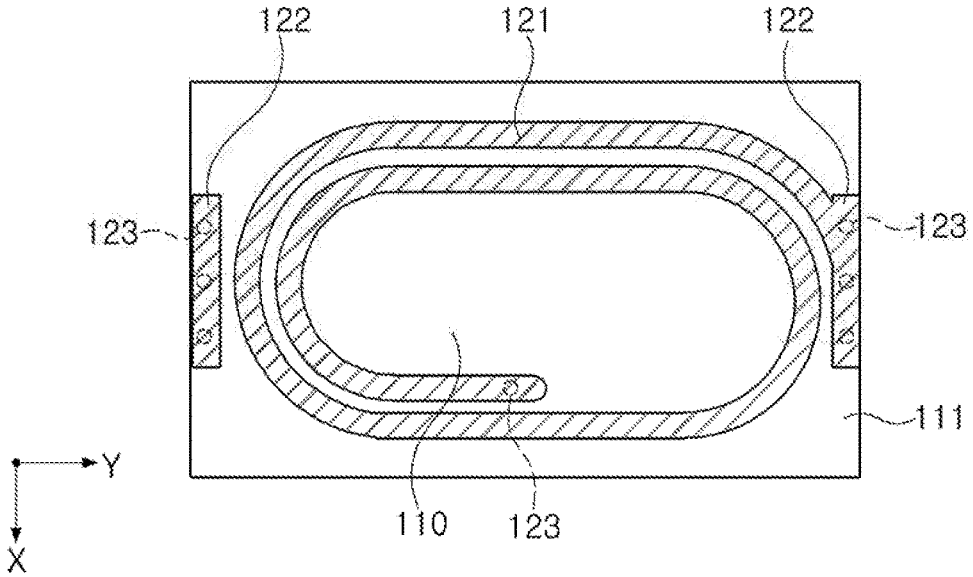

FIG. 1 is a schematic perspective view illustrating a coil electronic component according to an exemplary embodiment in the present disclosure. FIG. 2 is a cross-sectional view of the coil electronic component of FIG. 1, depicted so that coil patterns, connection patterns, and conductive vias are visible. FIGS. 3 and 4 are plan views illustrating coil layers that may be used in the coil electronic component of FIG. 1 in each position.

First, referring to FIGS. 1 and 2, a coil electronic component 100 may include a plurality of coil layers 12, conductive vias 123, and external electrodes 130 and 140. In this case, the plurality of coil layers 12 may each include coil patterns 121 having anisotropic plating layers and may form a stacking structure. In addition, the plurality of coil layers 12 may include connection patterns 122 formed outside the coil patterns 121 and connected to the external electrodes 130 and 140. However, the connection patterns 122 may not be used according to another exemplary embodiment. As in the present exemplary embodiment, a multilayer structure of the coil patterns 121 having the anisotropic plating layers may implement a stable inductor structure without using a substrate that is generally used in order to support the coil patterns, and may be advantageous in miniaturization of the coil electronic component 100 and improvement of electrical characteristics of the coil electronic component 100. In addition, an insulation distance between the coil patterns 121 may be short, and direct current (DC) current characteristics may thus be improved. The respective components constituting the coil electronic component 100 will hereinafter be described.

The plurality of coil layers 12 may include the coil patterns 121 and the connection patterns 122 disposed outside the coil patterns 121, as described above. In this case, first insulating layers 111 covering the coil patterns 121 may be formed. Here, the first insulating layers 111 may also cover the connection patterns 122. The first insulating layers 111 may be obtained by, for example, forming the coil patterns 121 and then coating the coil patterns 121 with a material such as a solder resist, or the like, as described below.

The coil patterns 121 may form a coil form in a stacking direction. In this case, as in a form illustrated in FIG. 2, the coil patterns 121 formed on different levels may be connected to each other through the conductive vias 123. The coil patterns 121 may include pad regions formed for connection to the conductive vias 123. However, the coil patterns 121 may not separately include pads as in the present exemplary embodiment (see FIGS. 3 and 4). Therefore, a coil region, a body region, or the like, of an inductor may be increased to improve characteristics of the coil electronic component 100. The connection patterns 122 may be disposed between the coil patterns 121 and the external electrodes 130 and 140 to allow stable electrical connection between the coil patterns 121 and the external electrodes 130 and 140 to be secured, and the connection patterns 122 provided on the respective coil layers 12 to be thus formed on different levels may be connected to each other by the conductive vias 123. In this case, a plurality of conductive vias 123 may be connected to one connection pattern 122 in order to improve reliability of electrical connection and electrical characteristics (see FIGS. 3 and 4).

In the present exemplary embodiment, the coil patterns 121 may be formed by a plating process, and may include the anisotropic plating layers. Therefore, the coil patterns 121 may include first layers L1 and second layers L2 formed on the first layers L1 and having widths greater than those of the first layers L1. As described below, the first layers L1 may be provided in a pattern plating form between third insulating layers 113 having a mask pattern form. In addition, the second layers L2 may include the anisotropic plating layers. In more detail, the coil patterns 121 may have a thickness greater than a width by applying an anisotropic plating process after isotropic plating. Meanwhile, the connection pattern 122 may have the same structure as that of the coil pattern 121, and a metal for forming the coil pattern 121 and the connection pattern 122 may be copper (Cu), silver (Ag), palladium (Pd), aluminum (Al), nickel (Ni), titanium (Ti), gold (Au), platinum (Pt), or mixtures thereof.

The conductive vias 123 may connect to the coil patterns 121 disposed on different layers to each other. The conductive via 123 may be formed of a plurality of plating layers, and may have, for example, a stacking structure of a Cu layer and an Sn layer. In this case, an intermetallic compound may be formed on an interface between the conductive via 123 and the coil pattern 121. In a case of using general build-up type printed circuit board (PCB) technology, a conductive via is formed of the same metal as that of a circuit pattern. Therefore, an intermetallic compound does not appear. However, in a case of using a collective stacking method as described below, a material constituting the coil pattern 121 and a material such as Sn configuring the conductive via 123 may be diffusion-bonded to each other, such that the coil pattern 121 and the conductive via 123 may be effectively electrically connected to each other. However, the conductive via 123 is not limited to being formed in a multilayer structure, but may also be formed of as a single layer structure.

Second insulating layers 112 may cover at least side surfaces of the first insulating layers 111, and an appropriate material selected from among materials that may be used as a material of one component forming a body of an inductor may be used as a material of the second insulating layer 112. An example of the material of the second insulating layer 112 may include a resin, ceramic, ferrite, or the like. In the present exemplary embodiment, the second insulating layers 112 may be provided as thin film mask patterns for forming the coil patterns 121, as described below. In this case, a photosensitive insulating material may be used as the material of the second insulating layer 112. Therefore, fine patterns may be implemented through a photolithography process. For example, a photosensitive organic material or a photosensitive resin may be included in the second insulating layer 112, and an inorganic component such as $SiO_2$/$Al_2O_3$/$BaSO_4$/Talc, or the like, may be further included as a filler component in the second insulating layer 112.

As in a form illustrated in FIG. 2, the third insulating layers 113 may cover side surfaces of the first layers L1 in the coil patterns 121. In more detail, the third insulating layers 113 may be in contact with the side surfaces of the first layers L1 and lower surfaces of the second layers L2. As described above, the third insulating layers 113 may be provided as mask patterns for forming the first layers L1 of the coil patterns 121, and may be formed of a photosensitive material. When the third insulating layers 113 are formed of the photosensitive material, the coil patterns 121, and the like, may be more finely implemented, which may be advantageous in miniaturization of the coil electronic component 100.

Forms of the coil patterns 121 and the connection patterns 122 will be described in more detail with reference to FIGS. 3 and 4. Each of the coil layers 12 may include a pair of connection patterns 122 in order to be connected to the external electrodes 130 and 140. In this case, the pair of connection patterns 122 may be disposed in positions opposing each other to face each other.

Coil patterns 121 of the uppermost coil layer and the lowermost coil layer of the plurality of coil layers 121 and 122 may be connected to one of a pair of connection patterns 122. In relation to FIG. 2, FIG. 3 illustrates the uppermost coil layer, and FIG. 4 illustrates the lowermost coil layer. The external electrodes 130 and 140 may include a first external electrode 130 and a second external electrode 140 of which polarities are different from each other. In this case, a connection pattern 122 (see the left of FIG. 3) of the uppermost coil layer of the plurality of coil layers 12 may be connected to the first external electrode 130, and a connection pattern 122 (see the right of FIG. 4) of the lowermost coil layer of the plurality of coil layers 121 and 122 may be connected to the second external electrode 140. Due to such a form, a coil structure may be formed by the plurality of coil layers 121 and 122 between the first and second external electrodes 130 and 140.

Meanwhile, when the numbers of coil layers 121 and 122 are three or more, coil patterns 121 of intermediate coil layers 121 and 122, which are coil layers disposed between the uppermost coil layer and the lowermost coil layer, may not be connected to the connection patterns 122. Even though the connection patterns 122 of the intermediate coil layers 121 and 122 are not connected to the coil patterns 121, one of a pair of connection patterns 122 may be connected to the first external electrode 130, and the other of the pair of connection patterns 122 may be connected to the second external electrode 140, as in a form illustrated in FIG. 2. In other words, one of the pair of connection patterns 122 included in each of the plurality of coil layers 12 may be connected to the first external electrode 130, and the other of the pair of connection patterns 122 may be connected to the second external electrode 140, and direct current (DC) resistance characteristics between the coil patterns 121 and the external electrodes 130 and 140 may be improved by such a structure. In addition, the external electrodes 130 and 140 may be effectively formed in a scheme such as spreading-plating, pre-plating, or the like, by using the connection patterns 122.

Meanwhile, as described above, the external electrodes 130 and 140 electrically connected to the plurality of coil layers 121 and 122 may be configured as a pair, and may be disposed in positions opposing each other. In this case, as in a form illustrated in FIG. 2, the external electrodes 130 and 140 may have a multilayer structure. For example, the external electrodes 130 and 140 may include first layers 131 and 141 and second layers 132 and 142, respectively. The first layers 131 and 141 may be pre-plating patterns in contact with the plurality of coil layers 121 and 122 and formed of Cu, or the like. Alternatively, the first layers 131 and 141 may have a flexible electrode form. In this case, the flexible electrodes may alleviate impact shock, or the like, acting on the coil electronic component 100. To this end, the flexible electrodes may have, for example, a structure including an insulating resin and conductive particles. The second layers 132 and 142 may include a plurality of plating layers in more detail. For example, the plurality of plating layers may include a nickel (Ni) plating layer and a tin (Sn) plating layer.

The coil electronic component 100 according to the present exemplary embodiment may further include a filler 110 including a core part. The filler 110 may be formed by filling a hole penetrating through the plurality of coil layers 121 and 122 with a magnetic material, or the like, as in a form illustrated in FIG. 2, and magnetic characteristics of the coil electronic component 100 may be improved by such a filler 110. In this case, the filler 110 may extend to upper and lower portions to cover upper and lower portions of the plurality of coil layers 121 and 122, as in a form illustrated in FIG. 2.

An example of a method of manufacturing the coil electronic component having the abovementioned structure will hereinafter be described with reference to FIGS. 5 through 13.

As described above, the coil electronic component described above may be manufactured by collectively stacking a plurality of unit laminates to correspond to one another. As an example, as illustrated in FIGS. 5 through 10, a unit laminate including insulating layers 111, 112, and 113, coil patterns 121, connection patterns 122, conductive vias 123, and the like, may be manufactured.

Figure 5:
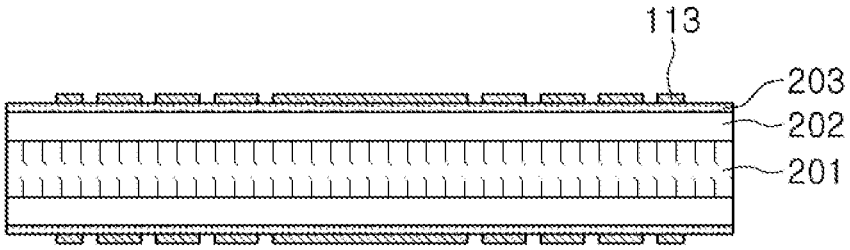
FIGS. 5 through 13 are views illustrating a method of manufacturing a coil electronic component according to an exemplary embodiment in the present disclosure.

First, as in a form illustrated in FIG. 5, a carrier layer 201 may be prepared, and mask patterns may be formed on the carrier layer 201. Here, the mask patterns may correspond to the abovementioned third insulating layers 113. The carrier layer 201 may be formed of a thermosetting resin, and copper foil layers 202 and 203 may be formed on a surface of the carrier layer 201. Therefore, the carrier layer 201 may be provided in a form of a copper clad laminate. The copper foil layers 202 and 203 may serve as seed layers for forming the coil patterns 121 and the connection patterns 122 or serve to easily separate the carrier layer 201 in a subsequent process, and may be omitted according to another exemplary embodiment. The third insulating layers 113 may have open regions having a shape corresponding to those of the coil patterns 121 and the connection patterns 122, more specifically, first layers L1 of these patterns, and may be obtained by, for example, exposing and developing photosensitive films.

Figure 6:
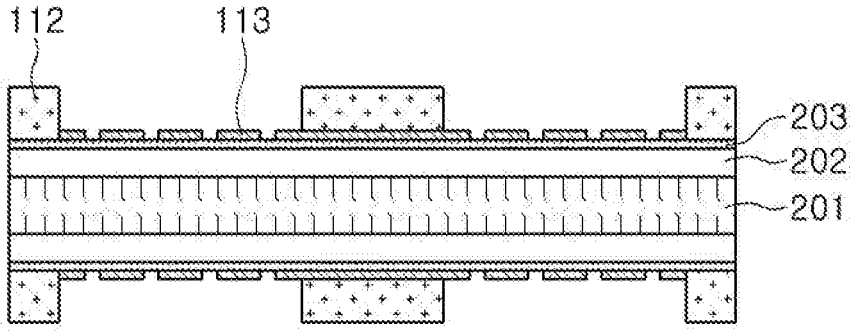

Then, as illustrated in FIG. 6, second insulating layers 112 may be formed. Here, the second insulating layers 112 may be obtained by exposing and developing photosensitive films, as described above. The second insulating layers 112 may be provided as mask patterns for forming the coil patterns 121 and the connection patterns 122, more specifically, second layers L2 of these patterns, and may have open regions having a shape corresponding to those of the coil patterns 121 and the connection patterns 122.

Figure 7:
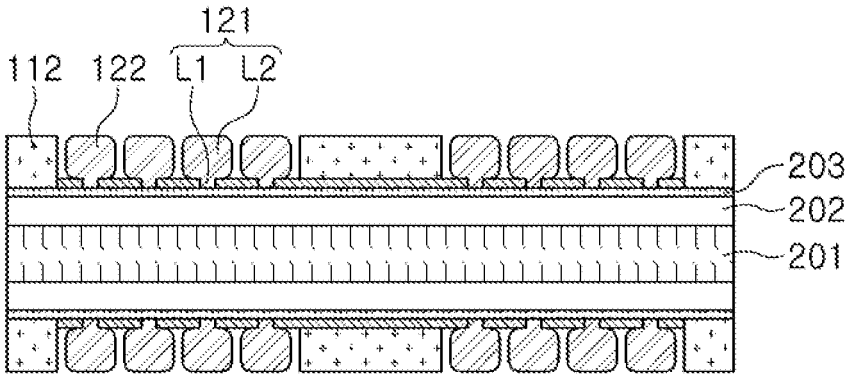

Then, as illustrated in FIG. 7, the third insulating layers 113 and the second insulating layers 112 may be used as mask patterns to form the coil patterns 121 and the connection patterns 122. As described above, the first layers L1 may be formed by pattern plating, and the second layers L2 may be formed by performing anisotropic plating after isotropic plating. In this case, the coil patterns 121 and the connection patterns 122 may be formed on both of upper and lower surfaces of the carrier layer 201. Therefore, two unit laminates may be obtained by a single process.

Figure 8:
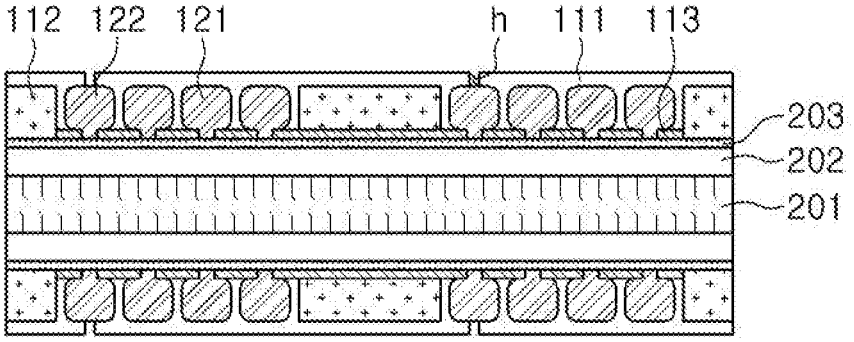
Figure 9:
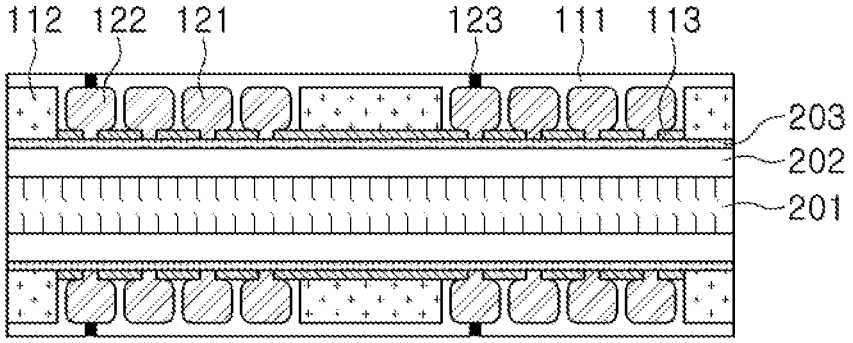

Then, as illustrated in FIG. 8, first insulating layers 111 covering the coil patterns 121 and the connection patterns 122 may be formed. The first insulating layers 111 may be formed by stacking solder resist films, or the like, on the coil patterns 121 and the connection patterns 122. In addition, portions of the first insulating layers 111 may be removed to form holes h for forming conductive vias. To this end, the first insulating layers 111 may be exposed and developed using ultraviolet (UV) light, or the like, to form the holes h. Then, as in a form illustrated in FIG. 9, conductive vias 123 filling the holes h of the first insulating layers 111 may be formed. For example, the conductive vias 123 having a multilayer structure may be formed by plating a Cu layer and an Sn layer.

Figure 10:
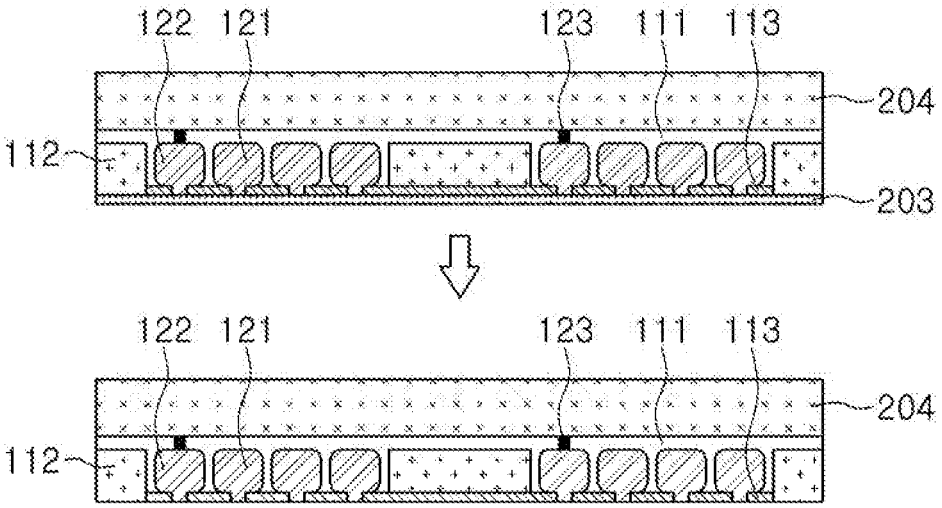

Then, as in a form illustrated in FIG. 10, the carrier layer 201 may be separated from the unit laminate including the insulating layers 111, 112, and 113, the coil layers 121 and 122, and the conductive vias 123 obtained by the above-mentioned processes. A support layer 204 may be formed on the insulating layer 111 for the purpose of the present separating process, if it is not necessary. In addition, when the copper foil layer 203 remains on the insulating layers 111, 112, and 113, the coil layers 121 and 122, and the like, after the carrier layer 201 is separated, the remaining copper foil layer 203 may be removed by appropriately applying the etching process known in the related art, as illustrated in a lower drawing of FIG. 10.

Figure 11:
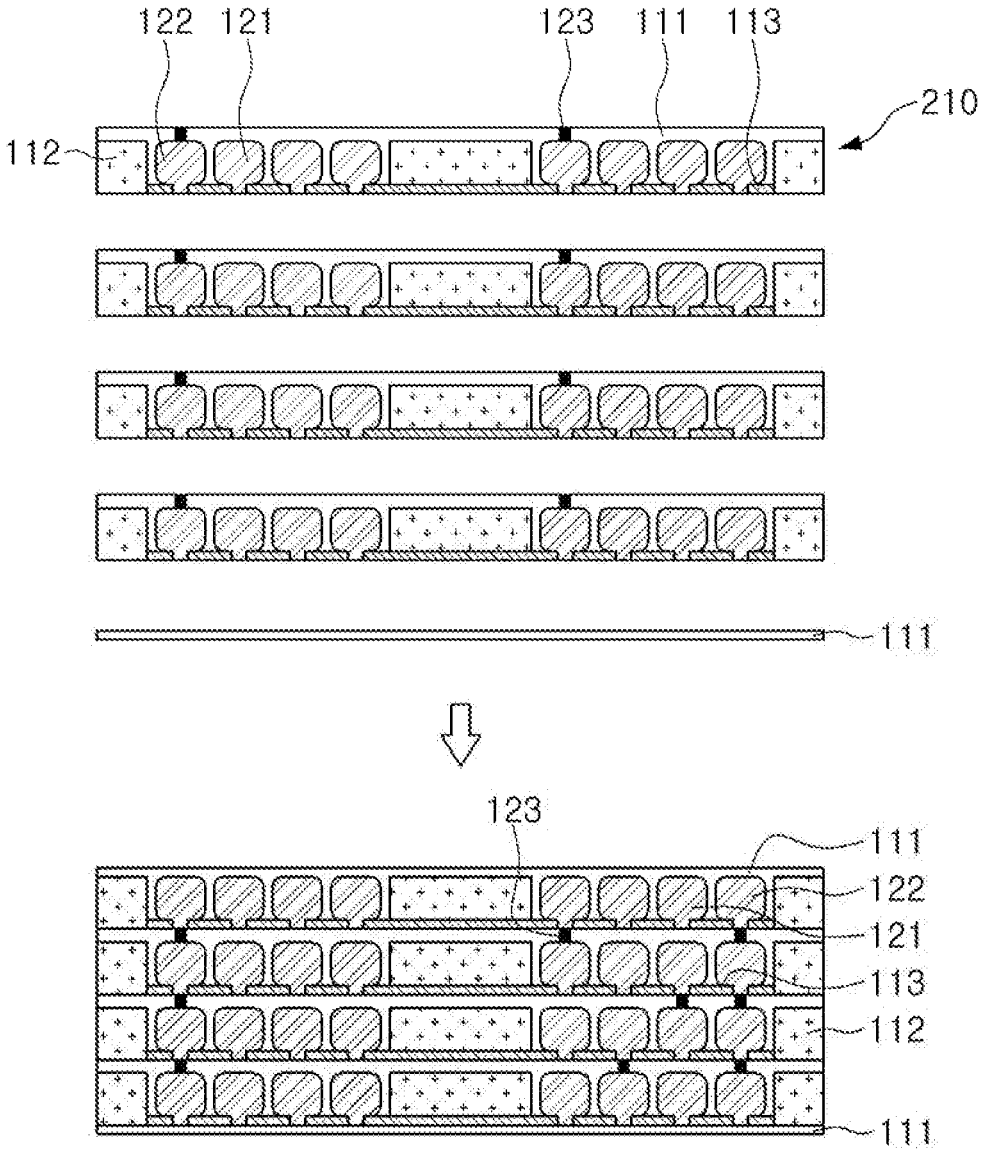

Then, as illustrated in FIG. 11, a plurality of unit laminates 210 that are individually obtained may be collectively stacked to correspond to one another. In this case, a stacking structure may be obtained by applying heat and pressure to the plurality of unit laminates. In addition, an additional insulating layer 111 may be disposed on the lowermost portion at the time of stacking the plurality of unit laminates 210. In the stacking structure obtained as described above, interlayer coupling may be stably implemented without performing a firing process.

As in the present exemplary embodiment, the unit laminates 210 manufactured in advance may be stacked simultaneously to form a body, resulting in a reduction in the number of processes and a process time as compared to a method of sequentially stacking the respective layers, which leads to a reduction in a process cost. In addition, the method of manufacturing the coil electronic component according to the present exemplary embodiment may be advantageous in effectively implementing specifications such as a size of the coil electronic component 100, electrical characteristics, and the like, by appropriately adjusting the number or thicknesses of coil layers 121 and 122. The plurality of unit laminates 210 are stacked simultaneously in the present exemplary embodiment, but the plurality of unit laminates may also be stacked two or more times depending on the number of unit laminates 210.

Figure 12:
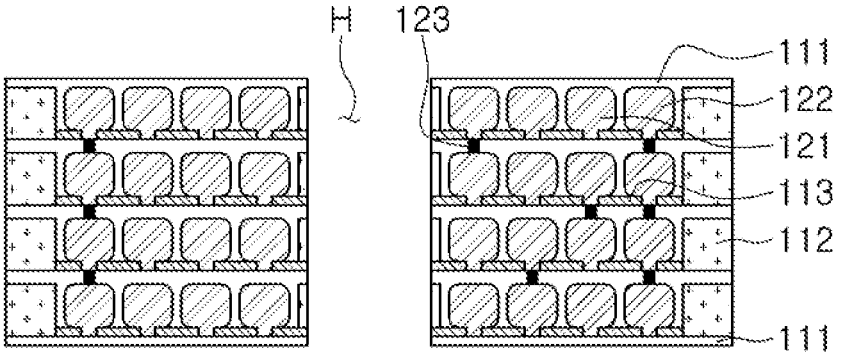
Figure 13:
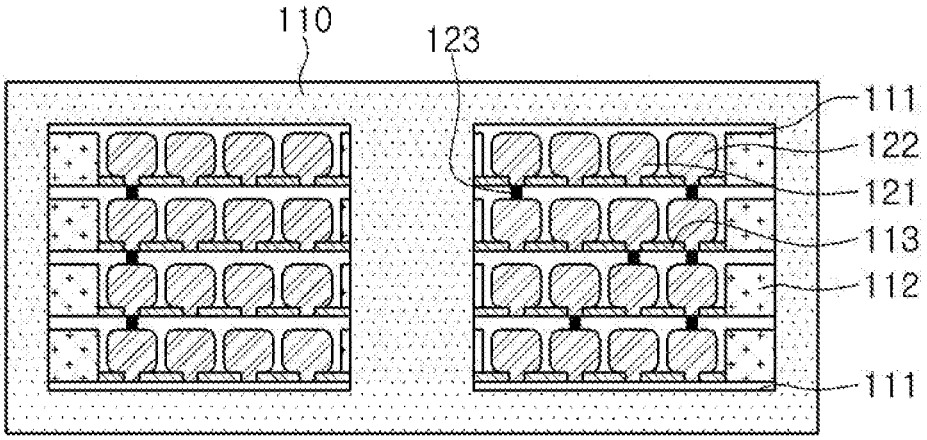

Then, as illustrated in FIGS. 12 and 13, a hole H may be formed in the coil layers 121 and 122, and may be filled with a magnetic material, or the like, to form a filler 110 including a core part. In this case, the filler 110 may be formed to cover side surfaces of the coil layers 121 and 122 and the insulating layers 111, 112, and 113. Then, portions of the filler 110 may be removed by an appropriate polishing process to expose the connection patterns 122, and the like. However, a process of forming the filler 110 is not a necessarily required process in the present disclosure, but may be omitted according to another exemplary embodiment. Then, external electrodes connected to the coil layers 121 and 122 may be formed to obtain the coil electronic component. In this case, the external electrodes may be effectively formed by applying a process such as spreading-plating, pre-plating, or the like, to the connection patterns 122 externally exposed.

As set forth above, when the coil electronic component according to the exemplary embodiment in the present disclosure is used, the coil electronic component may have a reduced thickness, which may be advantageous in terms of miniaturization. Furthermore, the coil electronic component may be implemented to have excellent electrical characteristics, and such a coil electronic component may be effectively manufactured by a collective stacking method, or the like.

While exemplary embodiments have been shown and described above, it will be apparent to those skilled in the art that modifications and variations could be made without departing from the scope of the present invention as defined by the appended claims.

What is claimed is:

1. A coil electronic component comprising:

a plurality of stacked coil layers, each of the coil layers including coil patterns including anisotropic plating layers, a first insulating layer covering the coil patterns, a second insulating layer covering at least side surfaces of the first insulating layer, and a third insulating layer disposed below the first insulating layer and on which the coil patterns are disposed;

conductive vias connecting the coil patterns formed on different coil layers to each other through the first insulating layer disposed between the coil patterns formed on different coil layers;

external electrodes electrically connected to the plurality of coil layers.

2. The coil electronic component of claim 1, wherein the coil patterns include first layers, and second layers formed on the first layers, the second layers having widths greater than those of the first layers.

3. The coil electronic component of claim 2, wherein the third insulating layer covers the side surfaces of the first layers.

4. The coil electronic component of claim 3, wherein the third insulating layer is in contact with the side surfaces of the first layers and lower surfaces of the second layers.

5. The coil electronic component of claim 3, wherein the third insulating layer is formed of a photosensitive material.

6. The coil electronic component of claim 1, wherein each of the plurality of coil layers further includes connection patterns disposed outside the coil patterns and externally exposed.

7. The coil electronic component of claim 6, wherein each of the plurality of coil layers includes a pair of the connection patterns.

8. The coil electronic component of claim 7, wherein the coil patterns of an uppermost coil layer and a lowermost coil layer of the plurality of coil layers are connected to one of the pair of connection patterns.

9. The coil electronic component of claim 8, wherein the external electrodes include first and second external electrodes of which polarities are different from each other, and a connection pattern of the uppermost coil layer of the plurality of coil layers is connected to the first external electrode and a connection pattern of the lowermost coil layer of the plurality of coil layers is connected to the second external electrode.

10. The coil electronic component of claim 6, further comprising conductive vias connecting the connection patterns formed on different levels to each other.

11. The coil electronic component of claim 1, further comprising a filler including a core part filling a hole penetrating through the plurality of coil layers and including a magnetic material.

12. The coil electronic component of claim 11, wherein the filler covers upper and lower portions of the plurality of coil layers.

* * * * *